US005709066A

United States Patent [19]

Prochaska et al.

[11] Patent Number: 5,709,066

[45] Date of Patent: Jan. 20, 1998

[54] INSERTER APPARATUS

[75] Inventors: Rodney R. Prochaska, Montgomery; David N. Segner, St. Bonifacius; Scott D. Docken, Norwood, all of Minn.

[73] Assignee: Colgate-Palmolive Company, New York, N.Y.

[21] Appl. No.: 697,186

[22] Filed: Aug. 20, 1996

Related U.S. Application Data

[60] Provisional application No. 60/002,577, Aug. 21, 1995.

[51] Int. Cl.[6] ..... B65B 63/04

[52] U.S. Cl. ..... 53/429; 53/474; 53/117; 53/157; 53/238

[58] Field of Search ..... 53/116, 117, 155, 53/157, 238, 239, 255, 429, 474

[56] References Cited

U.S. PATENT DOCUMENTS

| | | | |
|---|---|---|---|
| 1,909,050 | 5/1933 | Ferguson . | |
| 2,057,698 | 10/1936 | Thayer . | |
| 2,790,287 | 4/1957 | Kraft et al. | 53/157 |
| 2,795,906 | 6/1957 | Harker . | |
| 2,953,105 | 9/1960 | Rasmusson . | |
| 3,212,231 | 10/1965 | Pechmann . | |
| 3,280,533 | 10/1966 | Hall . | |
| 3,523,400 | 8/1970 | Daily | 53/117 X |
| 3,762,126 | 10/1973 | Court | 53/157 X |
| 4,561,921 | 12/1985 | Treiber . | |
| 4,611,457 | 9/1986 | Bittner | 53/429 |
| 4,614,074 | 9/1986 | Evers . | |
| 4,674,935 | 6/1987 | Feliks et al. . | |
| 4,817,363 | 4/1989 | St. Clair . | |
| 4,890,753 | 1/1990 | Duryee et al. . | |
| 5,457,934 | 10/1995 | Lehtola | 53/238 X |

FOREIGN PATENT DOCUMENTS

| | | |
|---|---|---|
| 0099669 | 2/1984 | European Pat. Off. . |
| 0161357 | 11/1985 | European Pat. Off. . |
| 0238009 | 9/1987 | European Pat. Off. . |
| 0568234 | 11/1993 | European Pat. Off. . |
| 1027536 | 4/1966 | United Kingdom . |
| 91/06481 | 5/1991 | WIPO . |

*Primary Examiner*—Daniel Moon
*Attorney, Agent, or Firm*—Michael McGreal

[57] ABSTRACT

The apparatus can insert into containers, such as narrow mouth bottles, a sheet of material having a lineal dimension which can be from about 2 to 5 times or more than the largest dimension of the container opening. Sheets of material are picked from magazines by a plurality of picker arms as a plurality of containers are moved into alignment. The picker arms move into position over each container. A stabilizer contacts the neck of each container, the stabilizer having a sheet material shaping and aligning mechanism. As the picker arms move downwardly into each container the sheet material is further formed into a tubular shape and inserted into the bottle. The sheet materials are released in the containers and the picker arms retracted from the containers.

13 Claims, 4 Drawing Sheets

INSERTER APPARATUS

This application claims the benefit of U.S. Provisional Application Ser. No. 60/002,577 filed Aug. 21, 1995 now abandoned.

This invention relates to an apparatus and method for inserting sheet items into narrow neck containers. More particularly this invention relates to an apparatus and method to take plurality of sheet items from a plurality of supply magazines and to insert the sheet items into narrow neck containers.

BACKGROUND OF THE INVENTION

In the production of products that are sold in containers there is a need in some instances for an apparatus to insert a sheet material into the container. This can be for the insertion of a coupon, instructions or a sales promotion item into the container. When this is a carton such as a cereal carton, or a large mouth jar such as a coffee jar, this can be quite easy. In those instances the item to be inserted into a container is of a smaller size than the container opening. In such instances the degree of control and indexing of the container to the inserter of the item is not too great. However, where the item to be inserted is of a dimension greater than the dimension of the container opening, there is difficulty. There is a need to alter the shape of the item while it is being transported to the container to be inserted into the container. Also, the container must be accurately indexed. This problem of inserting items into a container having an opening dimension of less than that of the item being inserted is solved in a novel way by the present apparatus and its method of operation.

There are various prior art techniques and equipment for inserting an item into or onto a container. In U.S. Pat. No. 4,817,363 there is disclosed a machine for inserting fitment spouts onto containers, such as detergent containers. A screw conveyor moves the containers to an inserter station where a spout is inserted and at a subsequent station pressed into place. U.S. Pat. No. 4,614,074 discloses a device for inserting straws into pouches as they are made and filled. U.S. Pat. No. 1,909,050 discloses a coupon inserting machine. This machine inserts coupons into large mouthed containers. U.S. Pat. No. 2,057,698 discloses a coupon inserting machine where the coupon is inserted in a curved position. These are placed into a large mouthed container. U.S. Pat. No. 2,795,906 discloses a device for inserting flexible strips into the large open mouth of a bag. U.S. Pat. No. 3,280,533 discloses a machine for inserting drug instructions into a bottle. In operation the sheet of instructions are folded into a tubular form and inserted into the container. There are yet other devices which insert lids and other closures onto containers. These latter machines align a container with a device to place the closure on the container.

None of these patents disclose an efficient way to handle a sheet of material and to insert it into a container opening which is much less in linear dimension than that of the sheet material to be inserted. However, this problem is solved in the present application for patent. There is disclosed a method and apparatus to insert sheet materials into containers having an opening much less in its dimensions than the dimensions of the sheet materials. The sheet material is accurately inserted into the containers on an automated filling line.

BRIEF SUMMARY OF THE INVENTION

The present invention is comprised of a method and apparatus for inserting sheet material into the narrow opening of a container, such as a bottle. The method is comprised of taking a sheet of material from a plurality of magazines by means of picker arms which pick the sheet material from the magazines and form and hold the sheet material in a curved orientation. A plurality of containers are simultaneously transported into a registered position. The sheet material is oriented into a further curved tubular-like orientation and inserted into the container by each picker arm moving downwardly into each container. The sheet material is released into the containers and the picker arms are withdrawn from the containers. These containers are then moved along the filling line and a new set of containers move into place for insertion of the sheet materials. The containers then are filled with a product, and preferably a liquid product.

The apparatus is comprised of a plurality of sheet material holding magazines and a plurality of picker arms that can rotatably move into contact with the magazines to take one sheet of material from each magazine. The picker arms then rotate to align with a plurality of containers which have been positioned by an alignment means. The picker arms in the next step then move downwardly into separate containers. Prior to the picker arms moving downwardly into the containers to insert the sheet material into the containers, a stabilizing means contacts at least an upper part of each container, preferably the neck and upper part of the body of the container. A means to further shape the sheet material into a curved tubular-like sheet is a part of the stabilizing means. This preferably is a conical shaped portion at an uppermost portion of the stabilizing means. A drive means moves the picker arms downwardly into each container and the means holding each sheet of material to a picker arm is released with the sheet material being deposited into each container. A reversing of the drive means removes the picker arms from each bottle and another cycle is started.

The means to hold the sheet material onto the picker arms preferably is a vacuum. The vacuum holds a sheet of material on the picker arm. In order to release the sheet material from each picker arm the vacuum is released.

The picker arms are in an assembly with the picker arms moving together as one unit. The picker arms due to the location of the vacuum openings at least partially form the sheet material into a tubular form.

The means to further shape the sheet material into a tubular shape preferably is a conical aperture that is a part of each stabilizing means and is aligned above each container.

The means to move and align the containers that are to receive a sheet of material preferably is a rotating screw which moves the containers along a conveyor.

The apparatus can place sheet material having a dimension of about 2 to 5 times the diameter of the opening of a container into the container. The sheet material is accurately picked from magazines, transported to container, shaped to a tubular form, and inserted into the container.

The method comprises moving a plurality of containers into alignment with a plurality of picker arms while rotating a picker arm assembly for the picker arms to pick sheets of material from magazines. The picker arms then rotate into alignment with the containers with container stabilizers contacting the containers along the upper portion of the container and preferably along an upper portion of the container and the neck of the container. The picker arms move downwardly into each container with the sheet of material being shaped to a more tubular form by the neck portion of the container stabilizer. The sheets of material are moved fully into the containers by the picker arms and deposited in the containers. A vacuum or some other mechanism holds and releases the sheets of material to and from the picker arms. Preferably a vacuum is used with the vacuum holding the sheet of material onto the picker arms. The vacuum is released when the picker arms are in the containers, thereby releasing the sheet material. The picker arms are removed from the containers and another cycle commenced. These method steps are then repeated.

DETAILED DESCRIPTION OF THE INVENTION

The invention will now be described in more detail with reference to the drawings.

Figure 1:
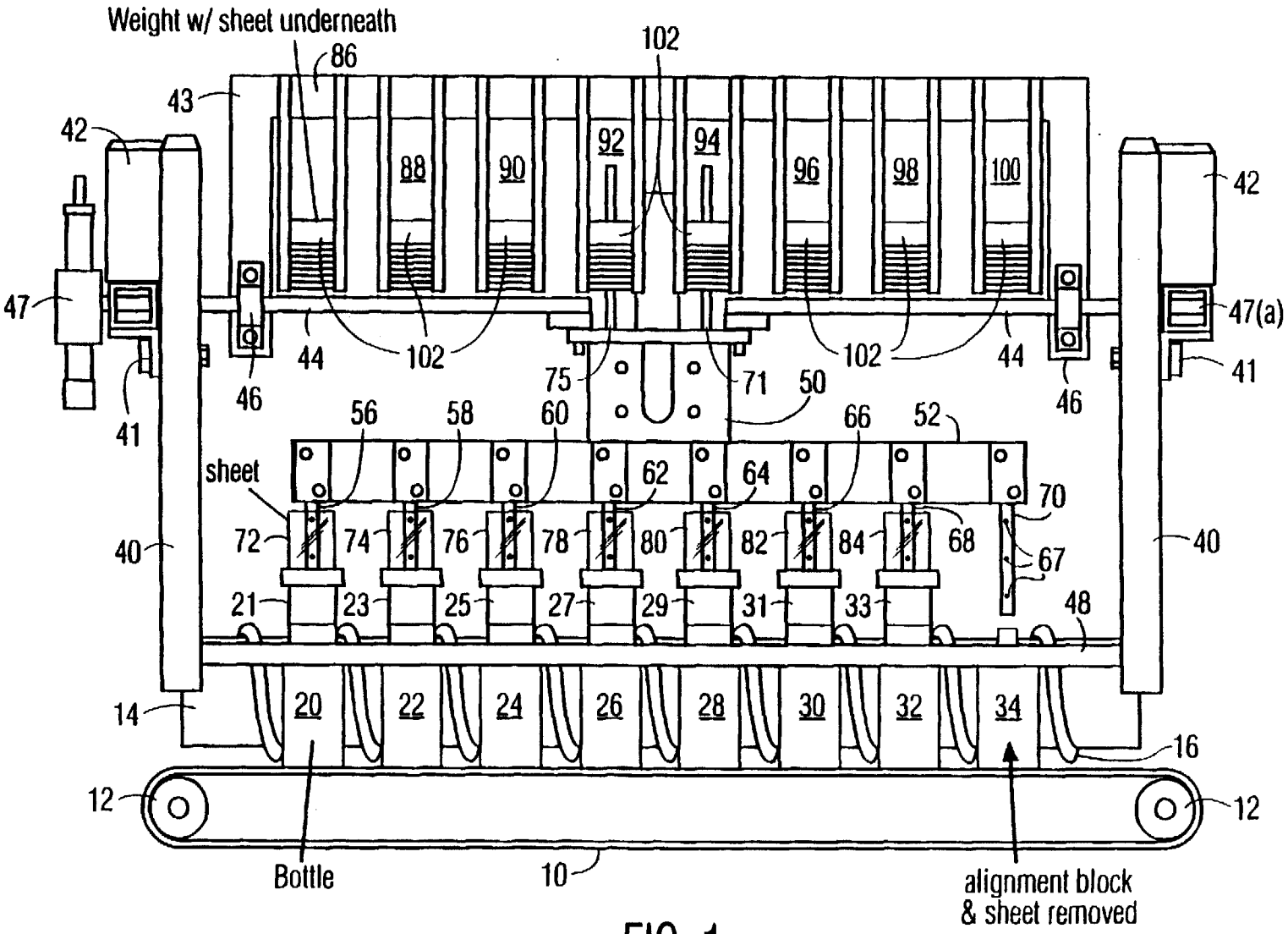
FIG. 1 is a front elevational view of the apparatus shown with the sheet material being inserted into the containers.

In FIG. 1 there is shown a front elevational view of the sheet material inserting apparatus. In this view bottles 20, 22, 24, 26, 28, 30, 32 and 34 are resting on conveyor 10. The bottles are moved and aligned for the insertion of the sheet materials by screw 14. The bottles fit between the turns of thread 16 of screw 14. The bottles are stabilized against screw 14 by a plurality of neck and body stabilizer guides 21, 23, 25, 27, 29, 31 and 33. These neck and body guides are carried by support 48 which in turn is connected to arms 40 to form a neck and body guide assembly. The neck and body guides are generally U-shaped alignment blocks and hold the necks and bodies of the bottles stable for the insertion of the sheet material. They contact an upper part of the bottle and neck as is seen with regard to bottle 34 in FIG. 1. At the opposite end of arms 40 are counterweights 42 to aid in the control of the motion of arms 40. Drives 47 and 47(*a*) function to rotate shaft 44.

The arms 40 are connected to support frame 85(see FIG. 3) by means of a screw and bolt connector 41. Also connected to support frame 85 is shaft 44. Picker arm assembly support 50 is connected to shaft 44. Picker arm assembly 52 is mounted onto picker arm assembly support 50. This picker arm support 52 carries picker arms 56, 58, 60, 62, 64, 66, 68 and 70. Each of these picker arms has a plurality of openings 67. A vacuum is drawn on the picker arms through these openings, this vacuum providing for the support of sheet materials 72, 74, 76, 78, 80, 82 and 84 on the picker arms and the temporary attachment to the picker arms openings. The arrangement of the openings on the picker arms also serves to form the sheet material into a rounded shape. In this view picker arm 54 is shown without the neck stabilizer guide for illustration purposes to show the functions that are performed by the neck and body stabilizer guides. In this view the sheet materials are being inserted down into the bottles.

Mounted on support 43 is picker arm assembly support 50. The magazines 86, 88, 90, 92, 94, 96, 98 and 100 supply the sheets of material. Each of these magazines carries a plurality of sheet materials. A weight 102 rests on each stack of sheet material. In operation the picker arms take sheet material from the bottom of each magazine and put each sheet of material into an aligned bottle.

Figure 2:
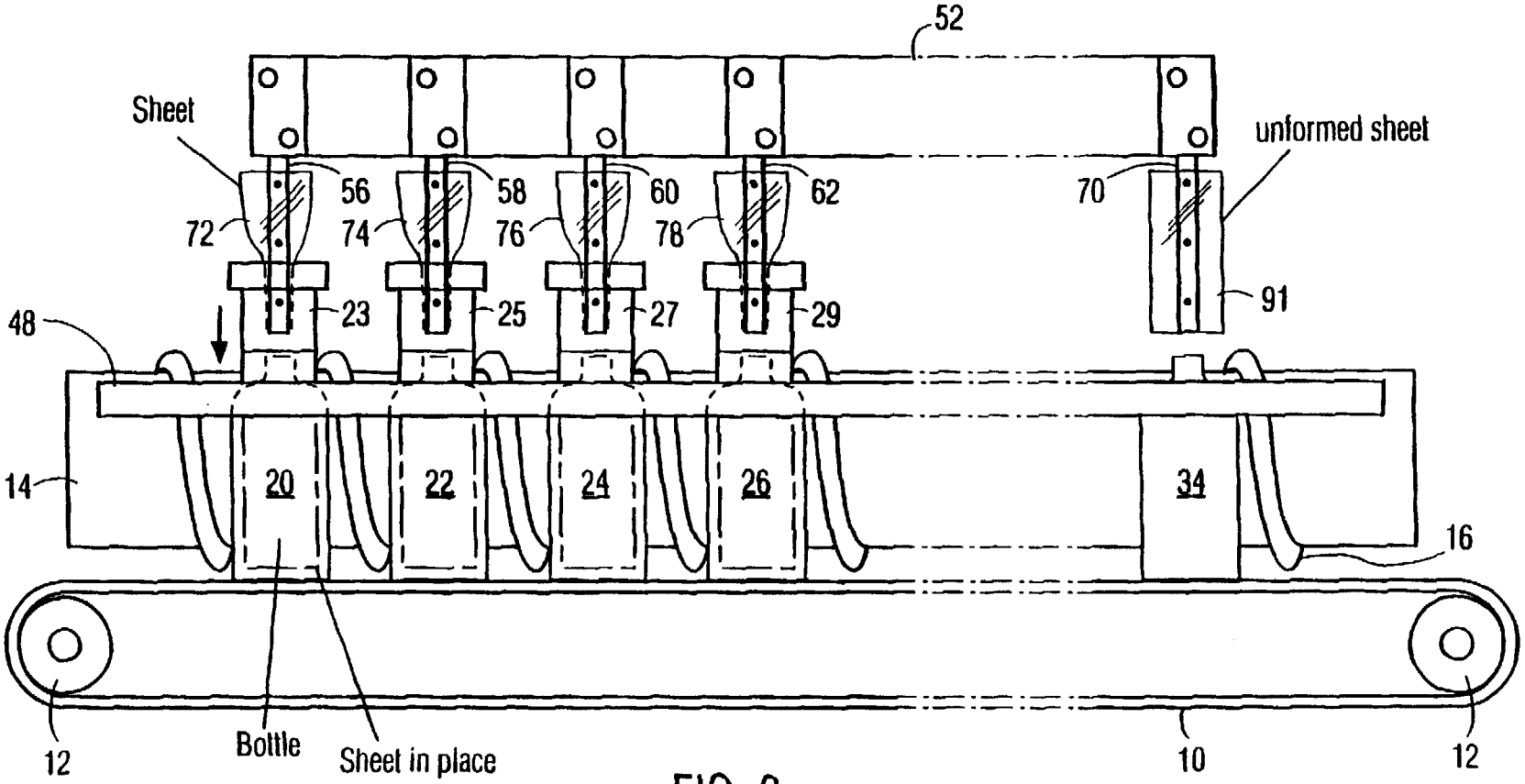
FIG. 2 is a section of the front elevational view of FIG. 1 showing the sheets of material being inserted into the containers.

FIG. 2 is an enlarged view of the inserting portion of the apparatus of FIG. 1 with the sheet material being formed into a curved tubular form by body and neck guides 23, 25, 27 and 29. The neck and body guides besides stabilizing the upper part of the bottles also serve to further shape the sheet material. Here the picker arm support 52 is shown moving the picker arms with the sheet materials downwardly into the bottles. The sheet materials 72, 74, 76, and 78 are shown being formed into a tubular shape. Sheet 91 is shown without a neck and body guide to show the tubular froming performed by the neck guides. When the picker arms are fully extended into the bottles, the vacuum is stopped and the sheet materials fall away from the picker arms. The sheet materials also move to regain a flat shape. The picker arms then are retracted from the bottles leaving the sheet material.

Figure 3:
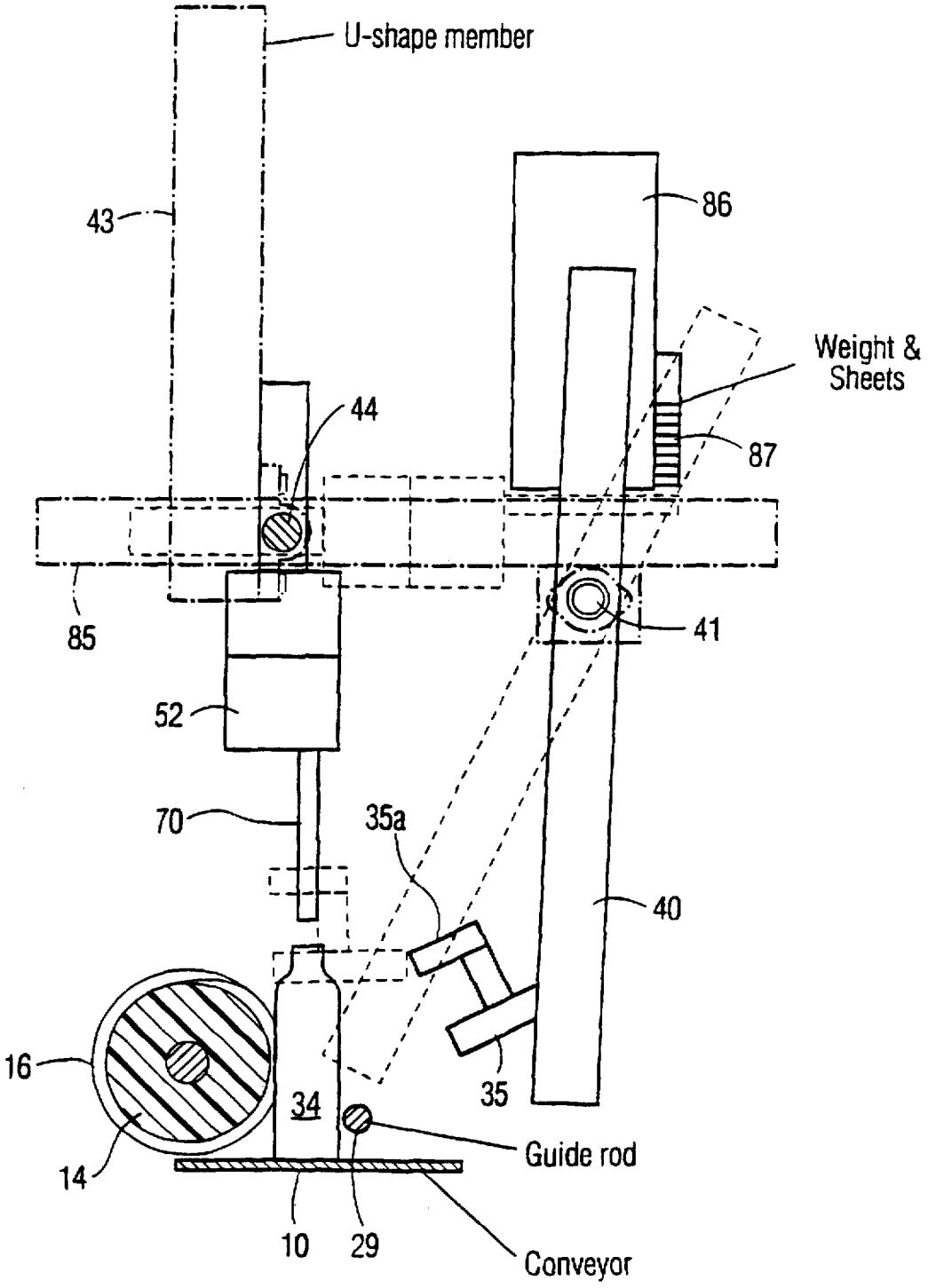
FIG. 3 is a side elevational view of the apparatus taking sheets of material from the magazines.

FIG. 3 is a right side elevational view of the inserter apparatus. In this view there is shown conveyor 10 along with screw 14 which carries thread 16. Bottle 34 is held on the conveyor by guide rail rod 29 and neck and body stabilizer guide 35. Top part 35(*a*) is conical in shape and serves to further shape the sheet material as seen in FIG. 2. This structure aligns and stabilizes the bottle 20 for the insertion of the sheet material. Arm 40 carries the neck guide 21 and pivots on shaft 41. Magazine 86 holds a plurality of sheets of material with weights 102 on the top of the stacks of sheet material. In this view, there also is shown picker arm 70 and picker arm support 52. Picker arm assembly support 50 rotates around shaft 44 and picker arm 70 picks sheet material from magazine 100. It oscillates upwardly and downwardly on shafts 71 and 75 to place the sheet material into each container. Support 85 is cantilevered from U-shape support frame 43 with the arms 40 and the magazines, which are mounted onto a support extending perpendicular to support 85.

Figure 4:
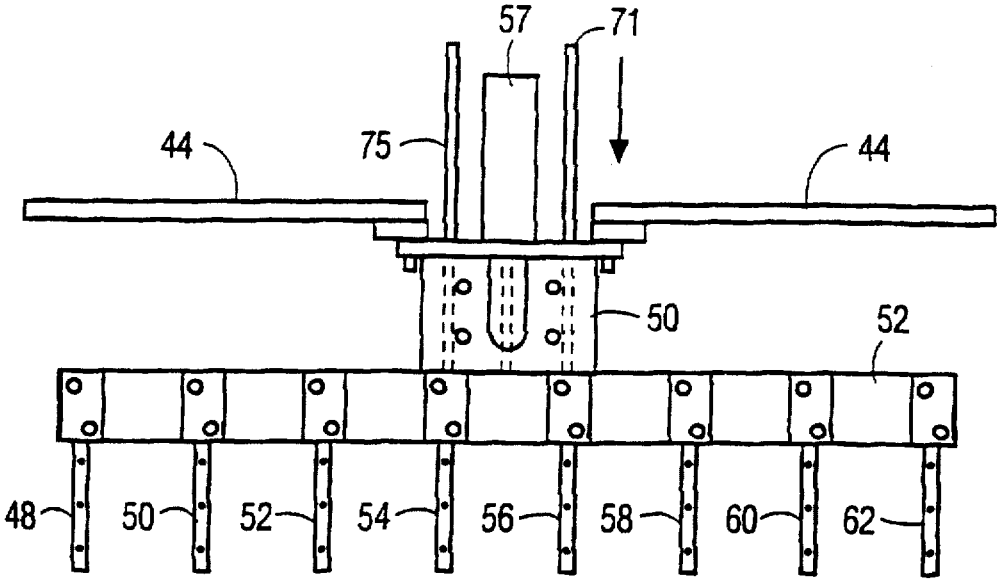
FIG. 4 is a front elevational view of the picker arm assembly with the picker arms retracted.
Figure 5:
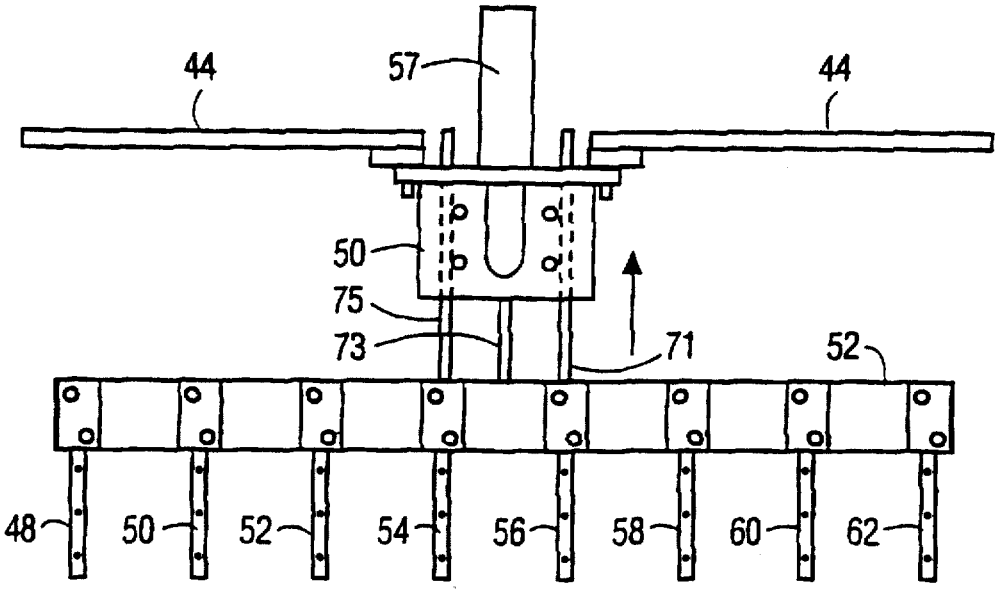
FIG. 5 is a front elevational view of the picker arm assembly with the picker arms extended.

In FIGS. 4 and 5 there is shown the operation of the picker arm assembly. The picker arm assembly support 50 rotates with shaft 44. Slideably mounted on picker arm assembly support 50 are rods 71, 73, and 75 which permit the picker arm assembly 52 to move upwardly and downwardly with respect to the picker arm assembly support 50. Solenoid 57 will control the upward and the downward motion of the picker arm assembly 50 on shafts 71, 73 and 75.

The mechanism to move the picker arm assembly support 50 upward and downward is activated after the picker arms 48, 50, 52, 54, 56, 58, 60 and 62 have each picked a sheet of material from a magazine and has rotated into position over a container. At this time the picker arm assembly support moves downwardly to insert the sheet materials into the containers.

Briefly, the operating sequence is for the picker arms to rotate upwardly to just under each magazine. A vacuum is simultaneously drawn on each picker arm. Each picker arm picks a sheet of material from a magazine. The picker arms then are rotated to a position over a container. Simultaneously the support 48 and body and neck guides move into place to hold the necks and upper portion of the containers in a stable alignment. The picker arm support then moves downwardly so that each picker arm and the sheet material that it carries enters a containers. The neck guide which has an upper conical shape also assists in shaping the sheet material into a more tubular form. When the picker arms have been fully extended into the bottles, the vacuum is ceased and the sheet materials are released from the picker arms. The sheet materials then unfold in the containers. The picker arms then are retracted and another cycle is started.

In more detail, the method of operating the apparatus set out in the figures comprises at the same time moving a plurality of containers into the inserter apparatus by the intermittent operation of conveyor 10 and screw 14 and picking a plurality of sheet materials from the magazines for insertion into the containers. A guide rod 29 maintains the containers on the conveyor and the body and neck guides 21, 23, 25, 27, 29, 31 and 33 align and stabilize the containers. The support 50 which carries the pick arms 56, 58, 60, 62, 64, 66, 68 and 70 rotates on shaft 44 to pick a sheet of material from each magazine. A vacuum is drawn on each pick arm; the picker arms contact each sheet material and hold each sheet material as the picker arm assembly is rotated to a position over the container. The picker arm assembly than moves downwardly with each picker arm along with the sheet materials inserted into the containers. The vacuum on the picker arms is released when the picker arms are in the container with the sheet materials being released and regaining some of their flat shape. The picker arms then are retracted from the bottles and the containers conveyed by conveyor 10 and screw 14 from the inserter apparatus to the filling station. A plurality of new containers then is moved into the inserter apparatus and the cycle repeated.

Any number of containers can be in the inserter apparatus at one time. Preferably the number of containers are about 8 to 16, but a lesser or greater number of containers can be used.

This device is very effective for inserting large sheet materials into bottles with small exit openings. This is due to the container neck stabilizers also functioning to put the sheet materials into a more tubular form.

This apparatus and method as described in this preferred embodiment can be modified in various ways. However, all such modifications of the methods and equipment are within the present concept.

We claim:

1. A method for inserting sheet material into containers comprising:

aligning on a support a plurality of containers having a body and a neck and a relatively narrow upper opening on said neck, with a container opening on said neck facing upwardly;

supporting at least two opposite surfaces of said containers;

providing a plurality of magazines, each holding a plurality of sheet material;

moving a picker arm into contact with each magazine, each picker arm removing a sheet material from a magazine;

stabilizing said plurality of containers by contacting the neck of said containers with a neck and body stabilizer guide moveable into and out of contact with said containers, said stabilizer guide having an upper sheet material shaping portion;

further moving a picker arm into alignment with each said container openings;

passing said sheet material through the upper sheet material shaping portion of said neck and body stabilizer guide to form said sheet material into an at least partially rounded form and inserting each sheet material into one of said containers.

2. A method as in claim 1 wherein said picker arms contact said magazines and by a vacuum drawn on each picker removes a sheet of material from each magazine, said vacuum being maintained until said sheet material has entered said containers.

3. A method as in claim 1 wherein said aligning comprises rotating a screw to adjust the position of said containers on said support.

4. A method as in claim 3 wherein supporting at least two opposite surfaces of said containers comprises contacting one surface of said containers with said screw which supports one surface of said containers and aligns said containers and contacting the other surface with said neck and body guide support moveable into and out of contact with said containers surface opposite said one surface.

5. A method as in claim 4 wherein said picker arms at least partially form said sheet material into a rounded form.

6. An apparatus for inserting sheet material into containers comprising:

a support for a plurality of containers, each of said containers having a body and a neck and a relatively narrow upper opening on said neck;

a plurality of holders for a plurality of said sheet material;

delivery means associated with each of said holders for moving each of said plurality of sheet material from each of said holders to above the upper opening of each container and then down into the upper opening of each container;

a neck and body stabilizer for each of said containers moveable into and out of contact with said containers comprising a portion which contacts the neck of each container and a portion above each container, said portion above each container being conical in shape and open at each end, the narrower opening being adjacent the relatively narrow upper opening on said neck of each container whereby upon the movement of said delivery means into said portion of said neck and body stabilizer above said containers and then into each said container said sheet material is formed into a rolled form and inserted through said relatively narrow neck of said container and into the body of said container.

7. An apparatus as in claim 6 wherein said neck and body stabilizer for each of said containers holds said containers against a horizontal shaft.

8. An apparatus as in claim 7 wherein said horizontal shaft is a rotating screw which aligns said containers with respect to each of said delivery means.

9. An apparatus as in claim 8 wherein opposite said screw there is a guide rod.

10. An apparatus as in claim 6 wherein said support comprises a conveyor.

11. An apparatus as in claim 6 wherein said holders comprise a plurality of magazines.

12. An apparatus as in claim 6 wherein said delivery means comprises a plurality of picker arms, each picker arm having a sheet material holder thereon and adapted to deliver said sheet material to a container.

13. An apparatus as in claim 12 wherein said holder of sheet of material uses a vacuum to hold said sheet of material.

* * * * *